US006097405A

United States Patent [19]

Lo et al.

[11] Patent Number: 6,097,405

[45] Date of Patent: Aug. 1, 2000

[54] DETECTION APPARATUS AND METHOD FOR USE IN A PRINTING DEVICE

[75] Inventors: Clement C. Lo, Lake Oswego; James P. Axtell, Portland, both of Oreg.

[73] Assignee: Hewlett-Packard Company, Palo Alto, Calif.

[21] Appl. No.: 08/723,329

[22] Filed: Sep. 30, 1996

[51] Int. Cl.[7] ..... B41J 29/38; B41J 2/175

[52] U.S. Cl. ..... 347/6; 347/86; 399/25

[58] Field of Search ..... 347/6, 19, 85–87, 347/49, 7; 399/25, 13

[56] References Cited

U.S. PATENT DOCUMENTS

| | | | |
|---|---|---|---|
| 3,786,931 | 1/1974 | Housholder | 211/40 |
| 3,971,917 | 7/1976 | Maddox et al. | 235/61.11 |
| 3,999,062 | 12/1976 | Demsky et al. | 250/227 |
| 4,032,889 | 6/1977 | Nassimbene | 340/146.3 |
| 4,059,225 | 11/1977 | Maddox | 235/437 |
| 4,155,652 | 5/1979 | Buchan et al. | 356/342 |
| 4,183,360 | 1/1980 | Carlson et al. | 128/666 |
| 4,248,509 | 2/1981 | Moyroud | 354/10 |
| 4,428,695 | 1/1984 | Jamieson | 400/249 |
| 4,692,603 | 9/1987 | Brass et al. | 235/454 |
| 4,716,421 | 12/1987 | Ozawa et al. | 347/14 |
| 4,739,339 | 4/1988 | DeYoung et al. | 346/140 R |
| 4,907,018 | 3/1990 | Pinkerpell et al. | 346/139 R |
| 4,907,019 | 3/1990 | Stephens | 346/140 R |
| 5,235,351 | 8/1993 | Koizumi | 347/14 |
| 5,250,956 | 10/1993 | Haselby et al. | 347/19 |
| 5,276,467 | 1/1994 | Meyer et al. | 347/19 |
| 5,289,208 | 2/1994 | Hasselby | 347/19 |
| 5,297,017 | 3/1994 | Hasselby et al. | 347/19 |
| 5,350,929 | 9/1994 | Meyer et al. | 250/573 |
| 5,430,306 | 7/1995 | Ix | 250/573 |
| 5,530,531 | 6/1996 | Girard | 355/260 |
| 5,547,501 | 8/1996 | Maruyama et al. | 106/31.14 |

FOREIGN PATENT DOCUMENTS

| | | | |
|---|---|---|---|
| 0779156A1 | 6/1997 | European Pat. Off. . | |
| 3782790T2 | 3/1988 | Germany . | |
| 60-32667 | 2/1985 | Japan | 347/7 |
| 5-345411 | 12/1993 | Japan | 347/19 |
| 8043174A | 2/1996 | Japan | G01F 23/28 |

OTHER PUBLICATIONS

Patent Abstracts of Japan; 07314720A; Dec. 5, 1995; Canon Inc.

Translation into English of Office Action for DE Application No. 19732628.5–27; Dec. 10, 1998; Hewlett–Packard Company.

*Primary Examiner*—John Barlow
*Assistant Examiner*—Craig A. Hallacher
*Attorney, Agent, or Firm*—Erik A. Anderson

[57] ABSTRACT

A detection apparatus for use in printing devices is disclosed including a container for storing a printing composition, a light source, a light detector, and a light waveguide. The waveguide conducts light from the source to the detector which is configured to enable printing by the device when the light from the source is detected. The detection apparatus may also, or alternatively, be configured to enable printing when either or both the container is coupled to the device in a printing orientation and/or the container with a printing composition having a particular characteristic is coupled to the device. In such configurations, the waveguide fails to conduct light from the source to the detector when the container is not in the printing orientation and/or the container with the particular characteristic is disconnected from the device.

printing device is also disclosed including a printing mechanism that prints an image, a printing composition, a body in which the printing composition is stored, a control mechanism that enables printing by the printing mechanism, and a circuit that includes a movable waveguide. The waveguide has a conducting position in which the control mechanism enables the printing mechanism and a nonconducting position in which the control mechanism disables the printing mechanism.

A container including a waveguide is additionally disclosed.

Methods are further disclosed that detect if a printing composition supply is coupled to the device in a printing orientation and/or if a printing composition supply having a particular characteristic is coupled to the device.

25 Claims, 14 Drawing Sheets

DETECTION APPARATUS AND METHOD FOR USE IN A PRINTING DEVICE

BACKGROUND AND SUMMARY

The present invention relates to an apparatus and method that utilizes a light waveguide to detect the presence, correct installation and/or printing composition characteristics of one or more printing composition containers in a printing device.

One of the main consumable items in printing is the printing composition (e.g., ink or toner) which is typically supplied in replaceable printing composition containers such as cartridges or bags. For proper printing device operation, the containers must be properly installed in the printing device. Failure to do so will cause improper operation and possible damage of the printing device, as well as possible contamination of the printing composition. For example, in a printing device which supports multiple colors of ink, it is desirable to avoid the unwanted mixing of different colors caused by the insertion of a printing composition container of one color into a position reserved for another color. When multiple printing devices are in use which require different ink or toner formulations having different characteristics, it is desirable to avoid the unwanted mixing of one ink or toner formulation into another. This may be caused by insertion of a printing composition container designed for one printing device into another incompatible printing device. It is also desirable to avoid operating a printing device when a required printing composition container is not installed, when a printing composition container is not fully installed, or when a printing composition container is installed in an improper manner.

Current solutions to these problems can be divided into two classes: passive and active. An example of a passive solution to ensure correct printing composition container installation is visual keying. With visual keying, a printing composition container and corresponding receptacle are visually marked with compatible symbols, colors, or words which guide the user to correct installation. With this type of solution, the printing device cannot prevent or detect an incorrect installation. Mechanical keying is an improvement to this type of passive solution. With mechanical keying, incorrect installation is prevented by having mechanical lock-out features on the printing composition container and on the receptacle. These features are designed to interfere or mate with each other thereby preventing printing composition container installation into all but the proper receptacle. A printing composition container may use both visual and mechanical keying.

Problems associated with such passive solutions include inability of detecting and informing the printing device when a required printing composition container has not been installed, has not been fully installed, or has been improperly installed. This limitation gives rise to the use of active solutions whereby means of actively sensing the printing composition container are used.

A common method of active sensing is to make electrical contact between the printing composition container and the printing device. If the electrical connection has not been made, then the printing composition container can be assumed not to be installed, not fully installed, or improperly installed. Electrical identification information incorporated within the printing composition container can also be used to further determine if the container has been installed in a correct receptacle.

A problem with electrical sensing is that of cost and reliability, particularly for containers which are not permanently connected to replaceable printheads. For printing composition containers with replaceable printheads, some electrical connections already exist so the addition of extra signals for container sensing adds a relatively small cost. Containers without printheads attached do not generally require any electrical connections. Therefore, the addition of printing composition container electrical sensing adds noticeable cost. For either configuration, electrical connections for container sensing must be made to each and every container thereby adding cost and increasing the number of connections where contaminates can form and cause reliability problems.

The present invention is directed to alleviation of the above-described problems associated with these currently known solutions. One aspect of the present invention relates to a detection apparatus for use in a printing device that determines whether one or more printing composition containers have been installed in a printing device. The detection apparatus includes at least one container for storing a printing composition, a source that generates a light signal, a detector that detects the light signal from the source when coupled to the source, and a light waveguide that is designed to conduct the light signal from the source to the detector. The detector, in turn, is designed to allow printing by the printing device when the light signal from the source is detected.

The detection apparatus can be designed to allow printing by the printing device only when the container is attached to the device in its proper printing orientation. Additionally or alternatively, the detection apparatus can be designed to allow printing by the printing device only when a container with a printing composition having one or more particular characteristics (e.g., fast drying black ink) is coupled to the device. In such configurations, the light waveguide is designed to fail to conduct light from the source to the detector when the container is not in the printing orientation and/or the container with the one or more particular characteristics is not connected to the device.

Another aspect of the present invention relates to a printing device that includes traditional elements of a printing device (e.g., a print head) plus a circuit that includes a light waveguide. The light waveguide has a conducting position, assumed when all printing composition containers are properly connected to the printing device, in which the printing device is allowed to print. The light waveguide also has a nonconducting position, assumed when any printing composition container is improperly connected to the printing device, in which the printing device is disabled.

Another aspect of the present invention relates to a printing composition container that includes a housing, a body inside the housing that stores a printing composition, and a light waveguide in the housing. The light waveguide is designed to conduct light from a light source to a light detector when the housing is coupled to the printing device in its printing orientation to allow printing by the printing device. The light waveguide is also designed to fail to conduct light from the light source to the light detector when the housing is not in the printing orientation.

The printing composition container may also include a filter (e.g., colored, polarized, or both) that conditions the light signal from the source. In such cases, the detector is configured to detect the conditioned light signal and allow printing only upon detection of the conditioned light signal. The filter may be separate element from the light waveguide or the light waveguide may be formed to act as a filter.

Another aspect of the present invention relates to methods that detect if a printing composition supply is attached to the device in its printing orientation and/or if a printing composition supply having a particular characteristic is attached to the device.

The light waveguide for the various aspects of the present invention may be inside or outside of the containers and housings. The light waveguide may also include two or more separate elements. A first set of these elements can be located in each container or housing and a second set of the elements can be located outside of the containers or housings. These elements can be located at different positions in each container or housing and can also or alternatively be different shapes (e.g., straight, bent or curved). Additionally, these elements may be of different constructions (e.g., light pipes, mirrors, prisms, or other optic elements).

The detection apparatus, printing device, and methods may also include one or more filters, like the filter discussed above in connection with the container. Additionally the above-described containers and bodies for the various aspects of the present invention may be made from bags, and the printing composition in these containers may be ink or toner.

Other objects, advantages, and novel features of the present invention will become apparent from the following detailed description of the invention when considered in conjunction with the accompanying drawings.

DETAILED DESCRIPTION OF THE DRAWINGS

Figure 1:
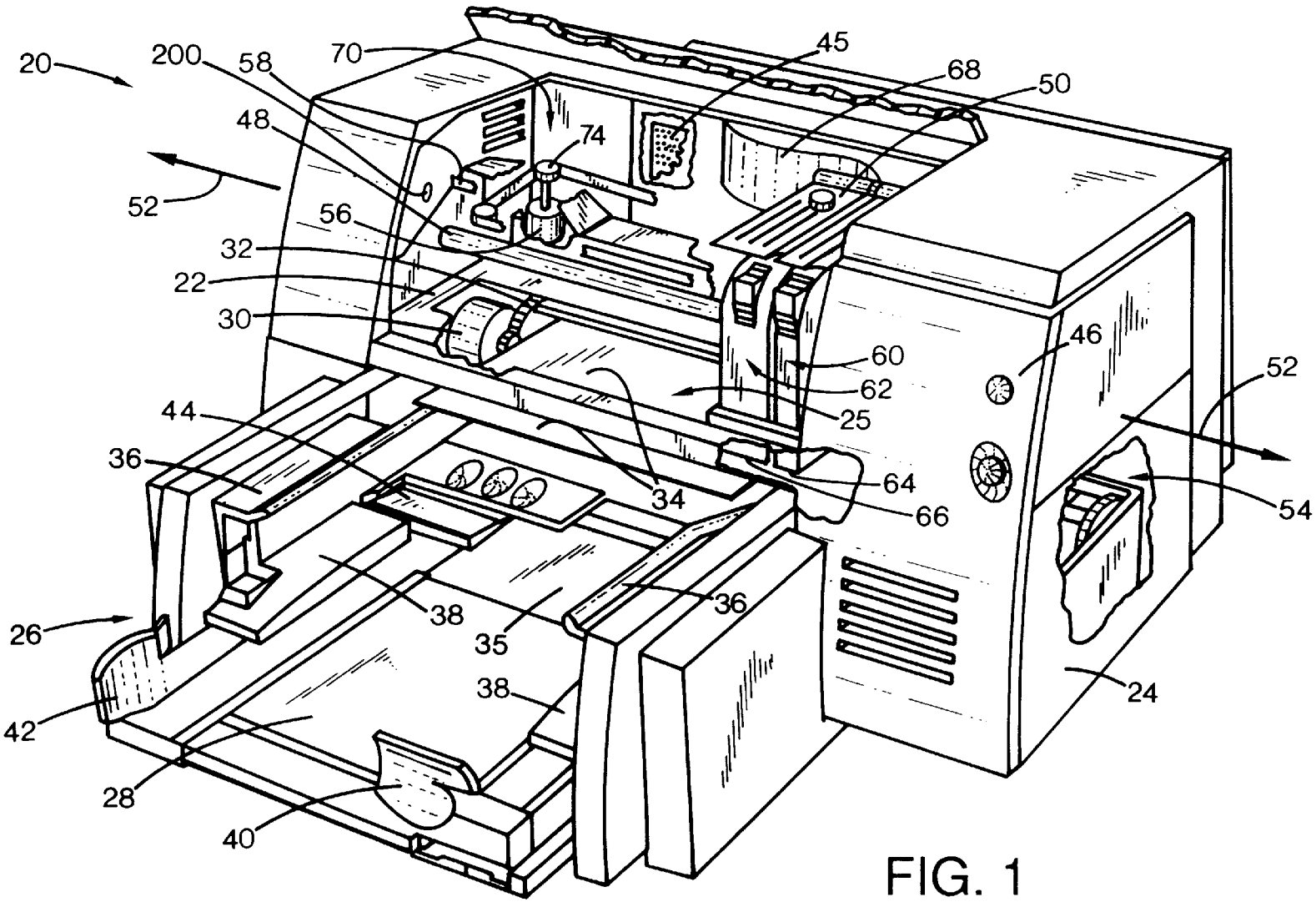
FIG. 1 illustrates is a partially cut away, perspective view of an inkjet printing device incorporating an embodiment of the present invention.

An embodiment of a printing device, here shown as an inkjet printer or printing device 20, constructed in accordance with the present invention is shown in FIG. 1. Inkjet printer 20 may be used for printing business reports, correspondence, desktop publishing, and the like, in an industrial, office, home or other environment. Although not shown, it is to be understood that the present invention may be used with a variety of other printing devices such as laser printers, plotters, portable printing units, copiers, cameras, video printers, and facsimile machines. For convenience, the concepts of the present invention are illustrated in the environment of an inkjet printer 20.

While it is apparent that the printer components may vary from model to model, the typical inkjet printer 20 includes a chassis or base 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like but, for convenience, the illustrated embodiment is described using paper as the print medium. The print media handling system 26 has a feed tray 28 for storing sheets of paper before printing. A series of conventional paper drive rollers (not shown), driven by a stepper motor 30 and drive gear assembly 32, may be used to move the print media, such as sheet 35, from tray 28 into print zone 25 for printing.

After printing, the motor 30 drives the printed sheet 35 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller or control mechanism 45, illustrated schematically as a microprocessor, that receives instructions from a host device, typically a computer, such as a personal computer (not shown). The printer controller 45 may also operate in response to user inputs provided through a key pad 46 located on the exterior of the casing 24. A monitor (not shown) coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a dual inkjet cartridge carriage system 50 for travel back and forth across the print zone 25. Carriage 50 is also propelled along guide rod 48 into a servicing region 54, as indicated generally by arrows 52, located within the interior of the housing 24. Carriage 50 has a pair of bearings which slideably support the carriage as it travels along the guide rod 48. A carriage DC motor 56 drives an endless belt 58. The motor 56 operates in response to control signals received from the controller 45. The belt 58 may be secured in a conventional manner to the carriage 50 to incrementally advance the carriage along guide rod 48 in response to actuation of motor 56.

In the print zone 25, the media sheet 35 receives ink from an inkjet cartridge or container, such as a black ink cartridge 60 and/or a color ink cartridge 62. The cartridges 60 and 62 are often called "pens" by those in the art. The illustrated color cartridge 62 is a tri-color pen, although in some embodiments, a pair of discrete monochrome pens may be used. While the color cartridge 62 may contain a pigment based ink, for the purposes of illustration, cartridge 62 is described as containing three dye based ink colors, such as cyan, yellow and magenta. The black ink cartridge 60 is illustrated herein as containing a pigment based ink. It is apparent that other types of inks may also be used in cartridges 60, 62, such as paraffin based inks, as well as hybrid or composite inks having both dye and pigment characteristics. Also, it is to be understood that the present invention may be used with other printing compositions such as toner and with printing compositions having different characteristics.

Figure 2:
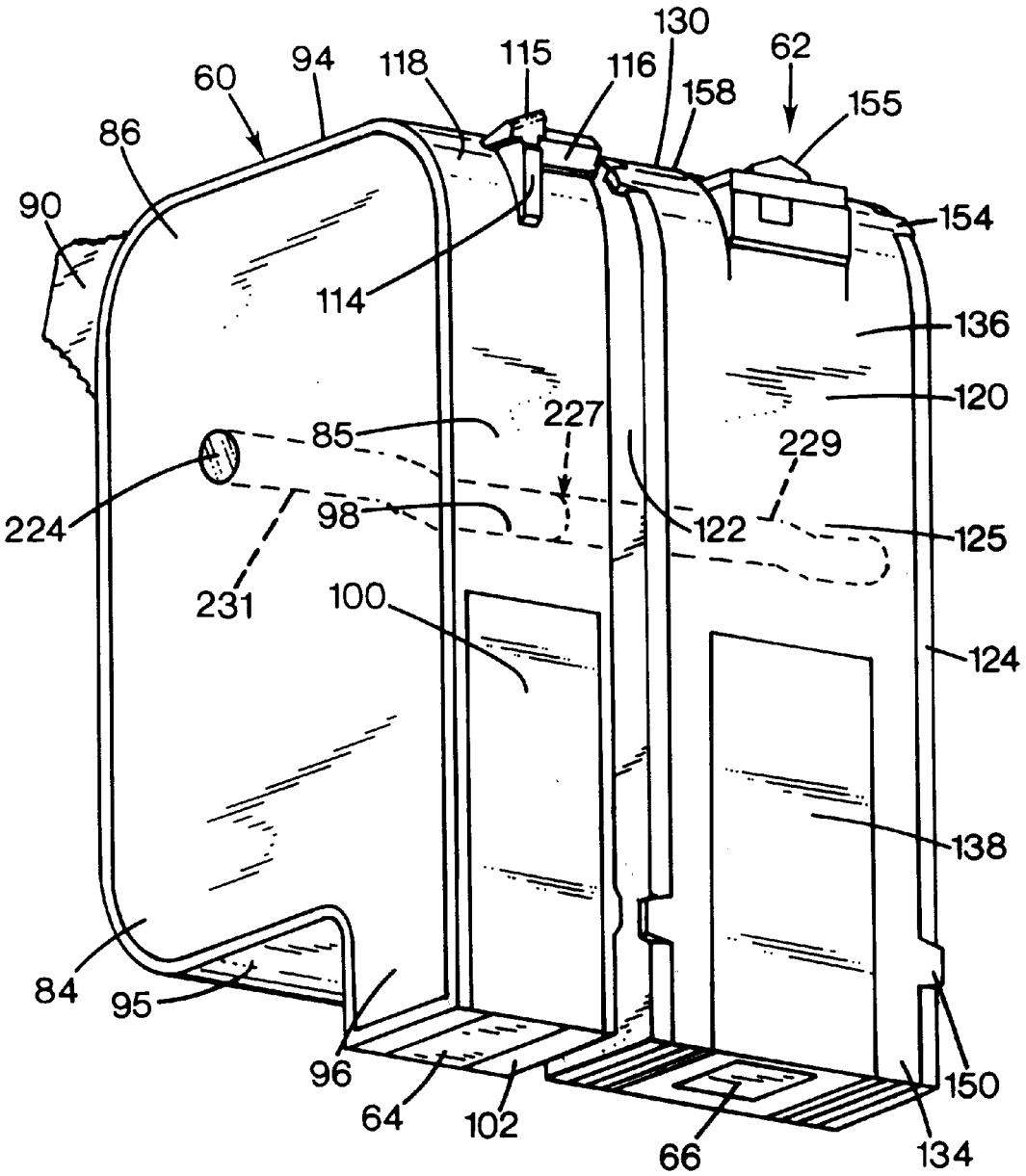
FIG. 2 is a rear perspective view of two inkjet cartridges shown in FIG. 1 that include an embodiment of a light waveguide of the present invention.
Figure 3:
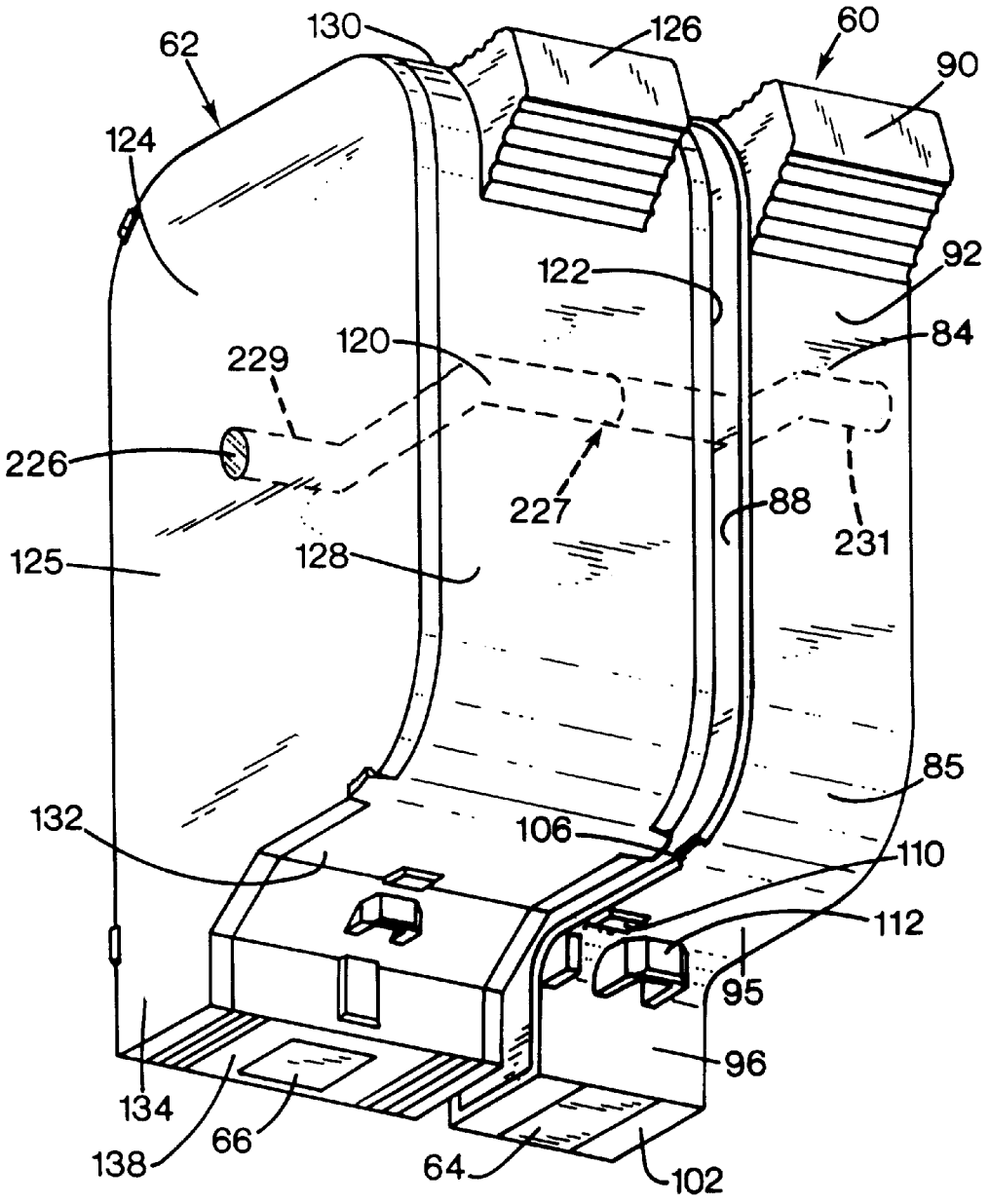
FIG. 3 is a front perspective view of the two inkjet cartridges of FIG. 1 that include an embodiment of the light waveguide of the present invention.

Referring to respective rear and front perspective views of the cartridges 60, 62 shown in FIGS. 2 and 3, cartridges 60, 62 each include a reservoir or body for storing a supply of printing composition (i.e., ink) therein. The cartridges 60, 62 have printing mechanisms or printheads 64, 66, respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multi-conductor strip 68 (see FIG. 1) from the controller 45 to the printhead carriage 50.

Referring again to FIGS. 2 and 3, the black cartridge 60 has a hollow housing 84 which stores a supply of ink, which is selectively ejected through nozzles within the printhead 64. The cartridge housing 84 includes an outer perimeter member 85, within which are seated an outboard side wall 86 and an inboard side wall 88. An insertion handle or gripping surface 90 is conveniently located between a front wall 92 and an upper wall 94 for use in installing and removing cartridge 60 from carriage 50. A bottom wall 95 extends between the front wall 92 and a nose portion 96 which houses the printhead 64. A rear wall 98 extends downwardly from the upper wall 94 to form a portion of nose 96.

The rear wall 98 supports a conventional flex tab circuit 100 having a plurality of electrical interconnect pads (omitted for clarity), which may be constructed as described in U.S. Pat. No. 4,907,018, assigned to the present assignee, Hewlett-Packard Company. In this location, the flex tab circuit 100 may be conveniently extended to make electrical contact with the printhead 64. Preferably, the handle 90, the perimeter walls 92, 94, 96, 95 and 98, as well as a printhead mounting wall 102 which receives printhead 64, are all molded as a single unitary part 85.

The outer perimeter member 85 also defines a latching land 115, which is sculpted by molding member 85 to include a contour having a sloped cam surface. The latching land 115 is useful in securely seating cartridge 60 within carriage 50. The latching land 115 lies adjacent a buttress member. The latching land cam structure 115 is located along an upper rear corner or shoulder 118 of the perimeter member 85, and below the upper wall 90. The shoulder surface 118 is particularly useful for installing and extracting the cartridge 60 from carriage.

The illustrated color cartridge 62 includes an outer perimeter member 120, which in the illustrated embodiment is sandwiched between an inboard side wall 122, and an outboard side wall 124, which together define a hollow housing 125. The hollow cartridge housing 125 preferably defines or houses three reservoirs for storing a supply of three colors of ink (e.g. cyan, magenta, and yellow), which is selectively ejected through nozzles within the printhead 66. In the illustrated embodiment, the cartridge 62 has an insertion handle or gripping surface 126 conveniently located between front and upper walls 128, 130, respectively. The handle 126 is useful for installing and removing the cartridge 62 from carriage 50. A bottom wall 132 joins the front wall 128 with a nose portion 134 which houses the printhead 66. A rear wall 136 extends downwardly from the upper wall 130 to form a portion of nose 134.

A conventional flex tab circuit 138, such as described above for flex tab circuit 100 may have a plurality of electrical interconnect pads (omitted for clarity) which are supported by the rear wall 136 to make electrical contact with the printhead 66. Preferably, the handle 126, the perimeter walls 128, 130, 132, 134 and 136, as well as a printhead mounting wall 138 which receives printhead 66, are all molded as a single unitary part 120.

A latching land 155, contoured to have a sloped cam surface, is joined to the outer perimeter member 120, for instance by bonding with adhesives, using ultra-sonic welding techniques, or other comparable methods known to those skilled in the art. The latching land 155 is useful in securely seating cartridge 62 within the carriage 50.

A light outlet 224 is formed in side wall 86 of cartridge 60 and a light inlet 226 (shown in FIG. 3) is formed in side wall 124 of cartridge 62. Although not shown, a light outlet is formed in side wall 122 of cartridge 62 and a light inlet is formed in side wall 88 of cartridge 60. A light waveguide 227, in accordance with the present invention is configured or designed such that when the elements of light waveguide 227 are aligned, a light signal from a source will be transmitted or conducted to a light detector to enable printing by a printing device. As can be seen in FIGS. 2 and 3, light waveguide 227 includes two light pipe elements, element 229 in cartridge 62 which is coupled to the light inlet and light outlet of that cartridge, and element 231 in cartridge 60 which is coupled to the light inlet and light outlet of that cartridge. These elements are shown as being cylindrically-shaped, bent or angled, and located at different positions within the cartridges. However, it is to be understood, that these elements may be differently shaped and/or located at different positions as well. Light pipes 229 and 231 may be made from plastic, glass, or other material having suitable light guiding properties, such as index of refraction.

Figure 4:
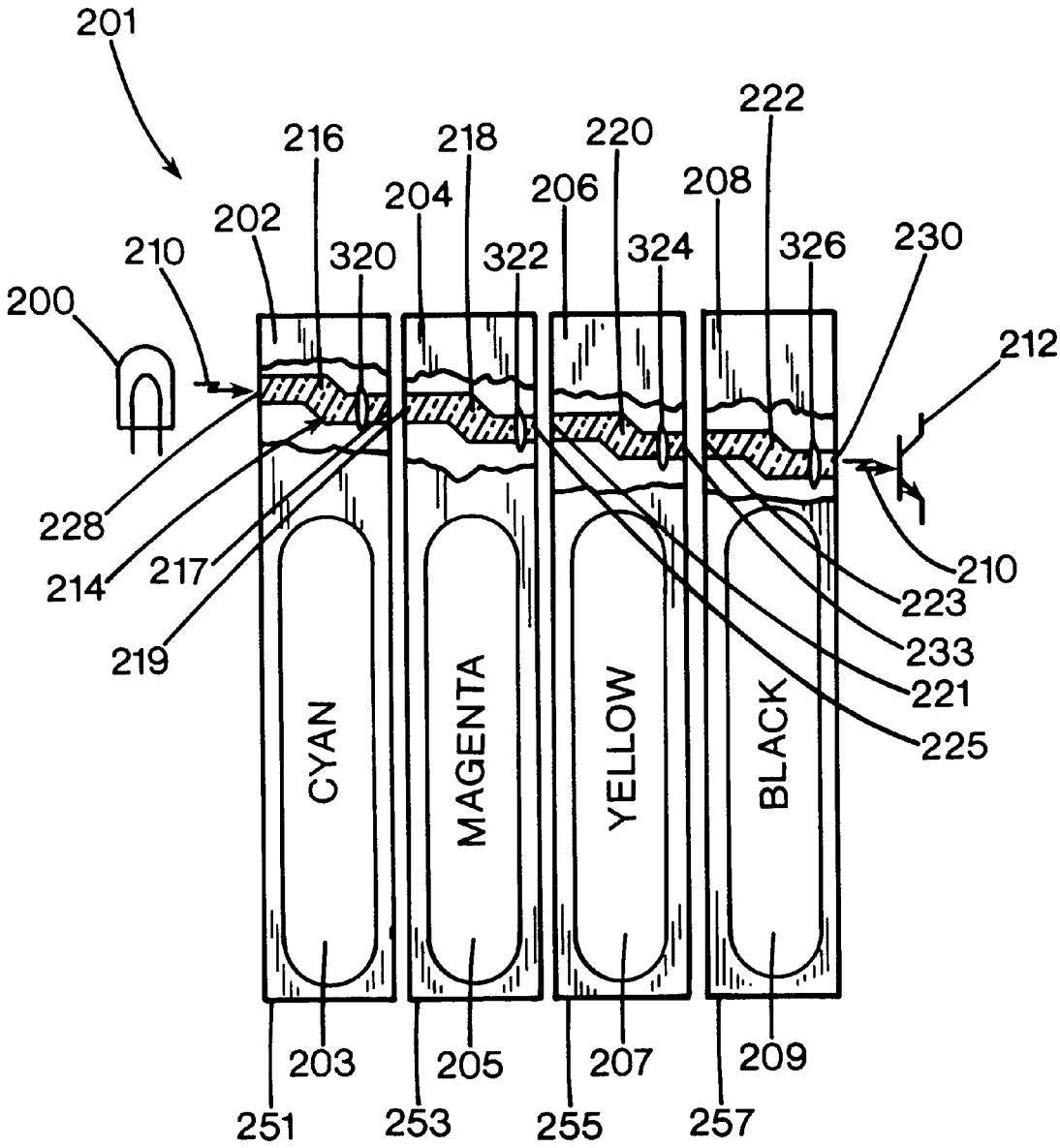
FIG. 4 is a view of a detection apparatus of the present invention in use to verify that four printing composition containers are installed in correct printing orientations in adjacent receptacles of a printing device.

A view of a detection apparatus 201 constructed in accordance with the present invention is shown in FIG. 4.

Detection apparatus 201 is used to verify that four printing composition containers 202, 204, 206, and 208 are installed in correct printing orientations in print receptacles of a printing device, such as printer 20. Containers 202, 204, 206, and 208 are illustrated as being respectively filled with four colors of ink: cyan, magenta, yellow, and black. It is to be understood, however, that other colors may be used. Containers 202, 204, 206, and 208 each include respective housings 251, 253, 255, and 257 that may be made from any suitable material, such as plastic. Containers 202, 204, 206, and 208 also each include a respective body 203, 205, 207, and 209 disposed in respective housings 251, 253, 255, and 257. Bodies 203, 205, 207, and 209 each store a printing composition, such as ink or toner, which is supplied to the printing device. Bodies 203, 205, 207, and 209 may include such things as bags.

Detection apparatus 201 includes at least one source 200 that emits a light signal that may be detected by at least one light detector 212, as more fully discussed below. A possible position for source 200 in printer 20 is shown in FIG. 1. Source 200 is illustrated in FIG. 4 as including a light bulb that emits a light signal 210. It is to be understood, however, that source 200 may include other types of light sources, such as one or more Light Emitting Diodes (LEDs) or lasers. Also, it is to be understood that the printing composition may alternatively include items such as toner and the containers may include items such as bags.

As discussed above, detection apparatus 201 also includes a light detector 212 that detects light signal 210 when coupled to source 200 via light waveguide 214. Detector 212 is coupled to printer controller or control mechanism 45 so that printing device 20 is enabled to print when detector 212 is coupled to source 200 and detects light signal 210. Although light detector 212 is shown as a bipolar transistor, it is to be understood that light detector 212 includes any number or types of elements, components or circuits that, individually or in combination, will detect light signal 210 and function with printer control or control mechanism 45 to enable printing by printing device 20 when detector 212 is coupled to source 200 and detects light signal 210.

As can be seen in FIG. 4, light waveguide 214 includes a plurality of elements disposed inside of containers 202, 204, 206, and 208. These elements are shown as light pipes 216, 218, 220, and 222 in FIG. 4. However, it is to be understood that the light waveguide may also include mirrors, prisms, and/or other optic elements that are used in conjunction with these lights pipes or that replace one or more of them.

As can also be seen in FIG. 4, light pipe elements 216, 218, 220, and 222 are each bent or angled, and are located at different positions within respective containers 202, 204, 206, and 208. Light pipe elements 216, 218, 220, and 222 may be made from plastic, glass, or other material having suitable light guiding properties, such as index of refraction. Although not shown, it is to be understood that in other embodiments of the present invention, at least one of the light pipes may be straight or curved and, additionally or alternatively, some of the light pipes may be located in the same positions within their respective containers.

A light inlet 228 is formed in housing 251 through which light signal 210 may enter. A light outlet 217 is also formed in housing 251 through which light signal 210 may exit. As can be seen in FIG. 4, light inlet 228 is offset from light outlet 217 such that light waveguide element 216 is bent or angled. Light waveguide element 216 is coupled to light inlet 228 and light outlet 217 so that if light signal 210 enters housing 202 through light inlet 228, it is conducted to light outlet 217. As can also be seen in FIG. 4, containers 204, 206, and 208 also include respective light inlets 219, 221, and 223, as well as respective offset light outlets 225, 233, and 230 such that elements 218, 220, and 222 are bent or angled. Elements 218, 220, and 222 are coupled to the inlet and outlet of the housing in which they are disposed such that they conduct light that enters the inlet to the outlet. As, can be further seen in FIG. 4, the light inlet of each of the containers is offset from at least one of the light outlets of another container. For example, light inlet 228 is offset from light outlets 230.

Source 200 is shown as emitting a light signal 210 into light inlet 228 of light pipe element 216. Light signal 210 is transmitted through light pipe element 216 to light outlet 217, then to light inlet 219 of light pipe element 218, and so on until it emerges from light outlet 230 of light pipe element 222 and strikes light detector 212. A complete light conducting path or light circuit is thereby formed from light source 200 to light detector 212. The detection of light indicates that a proper installation has been accomplished. That is, that containers 202, 204, 206, and 208 have been installed in a printing device in their respective printing orientations. When the light conducting path is disrupted, light signal 210 from source 200 is prevented from reaching detector 212, thereby indicating an error in installing one or more of containers 202, 204, 206, and 208.

Figure 5:
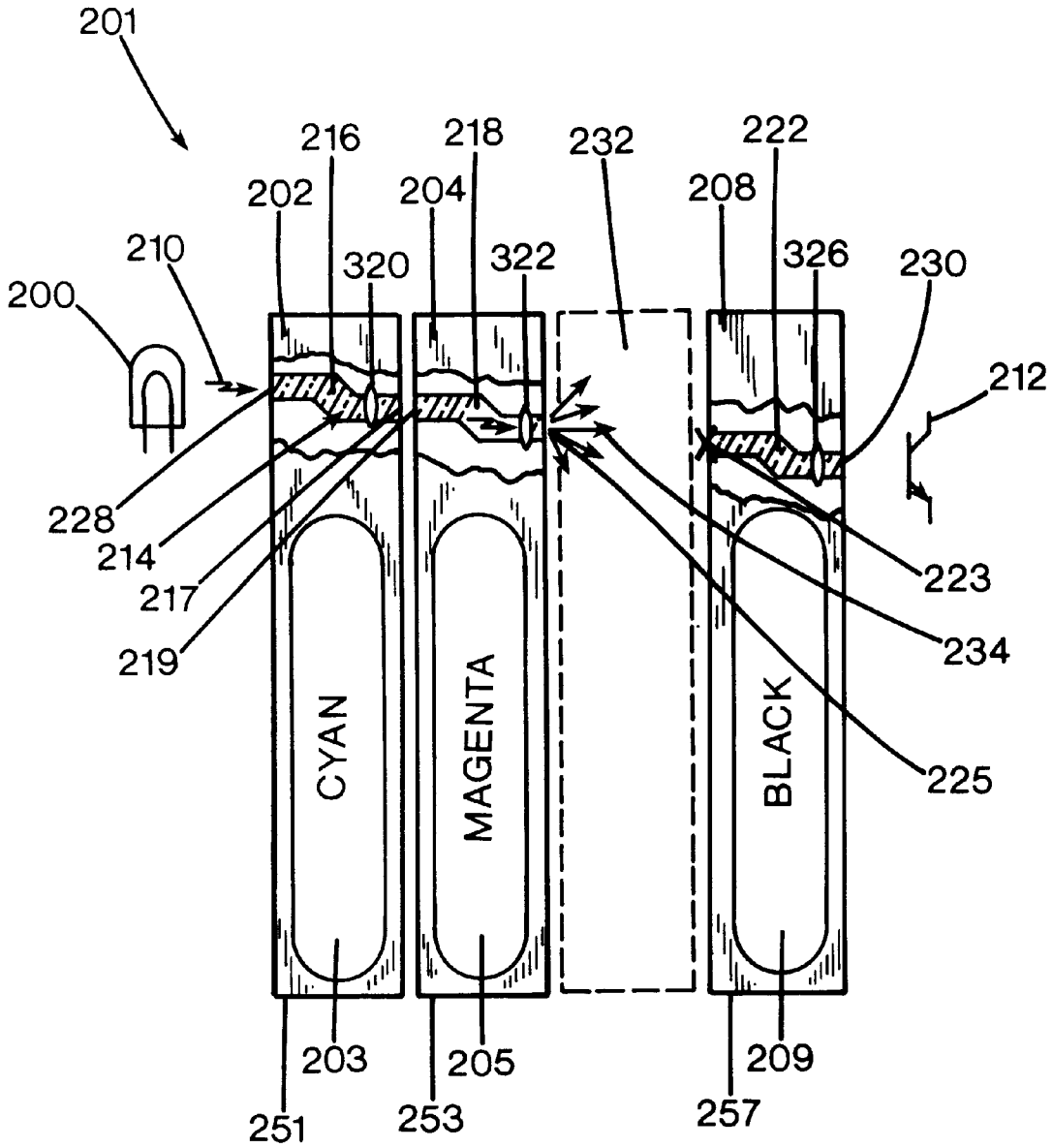
FIG. 5 is a view of the detection apparatus of FIG. 4 indicating that one of the printing composition containers is missing from the printing device.

FIG. 5 is a view of an example where a required ink container 206 is not installed. Light signal 210 is no longer guided or channeled across receptacle opening 232 by light pipe element 220. Instead, light signal 210 diffuses into the air once it exits light outlet 225, as generally indicated at 234. Some light may still enter light inlet 223, but since the light is no longer guided across receptacle opening 232 via light pipe element 220, a reduction in light signal level will occur. This is generally indicated by an "X" at light inlet 223. This drop in light level can be detected by detector 212 and the associated error condition thereby indicated.

Various means can be used to help ensure that detector 212 is detecting light signal 210 from light source 200 rather than ambient light. For example, the intensity of light signal can be varied so that light signal 210 is stronger than any ambient light. As a another example, light signal 210 can be modulated at source 200 and demodulated by detector 212. As a further example, the shape of light signal 210 can be controlled by source 200 and detector 212 tuned to recognized only this waveform. These examples are illustrative of three possible ways in which the above-noted problem can be solved and should not be regarded as excluding other solutions. Furthermore, two or more of these three solutions may be combined.

Figure 6:
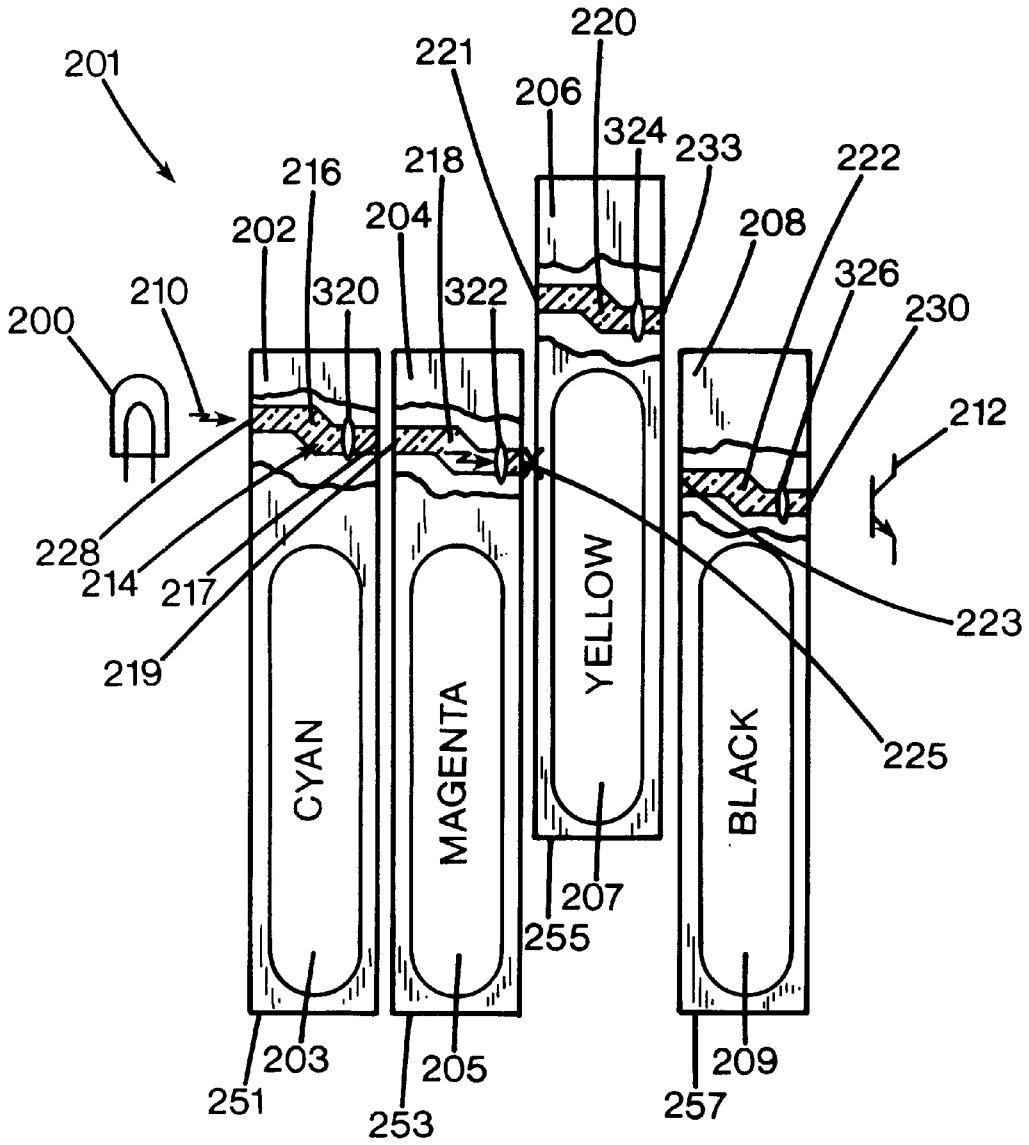
FIG. 6 is a view of the detection apparatus of FIG. 4 indicating that one of the printing composition containers is not properly installed.

FIG. 6 is a view of an example of improper container installation. Specifically, ink container 206 has been installed, but not properly seated. Light pipe element 220 within container 206 is not aligned with the other light pipe elements 218, and 222, thereby disrupting the light path for light signal 210. This is generally indicated by an "X" at light outlet 225 of light pipe element 218. The blocked light path prevents detector 212 from receiving light signal 210 which indicates the error condition.

Figure 7:
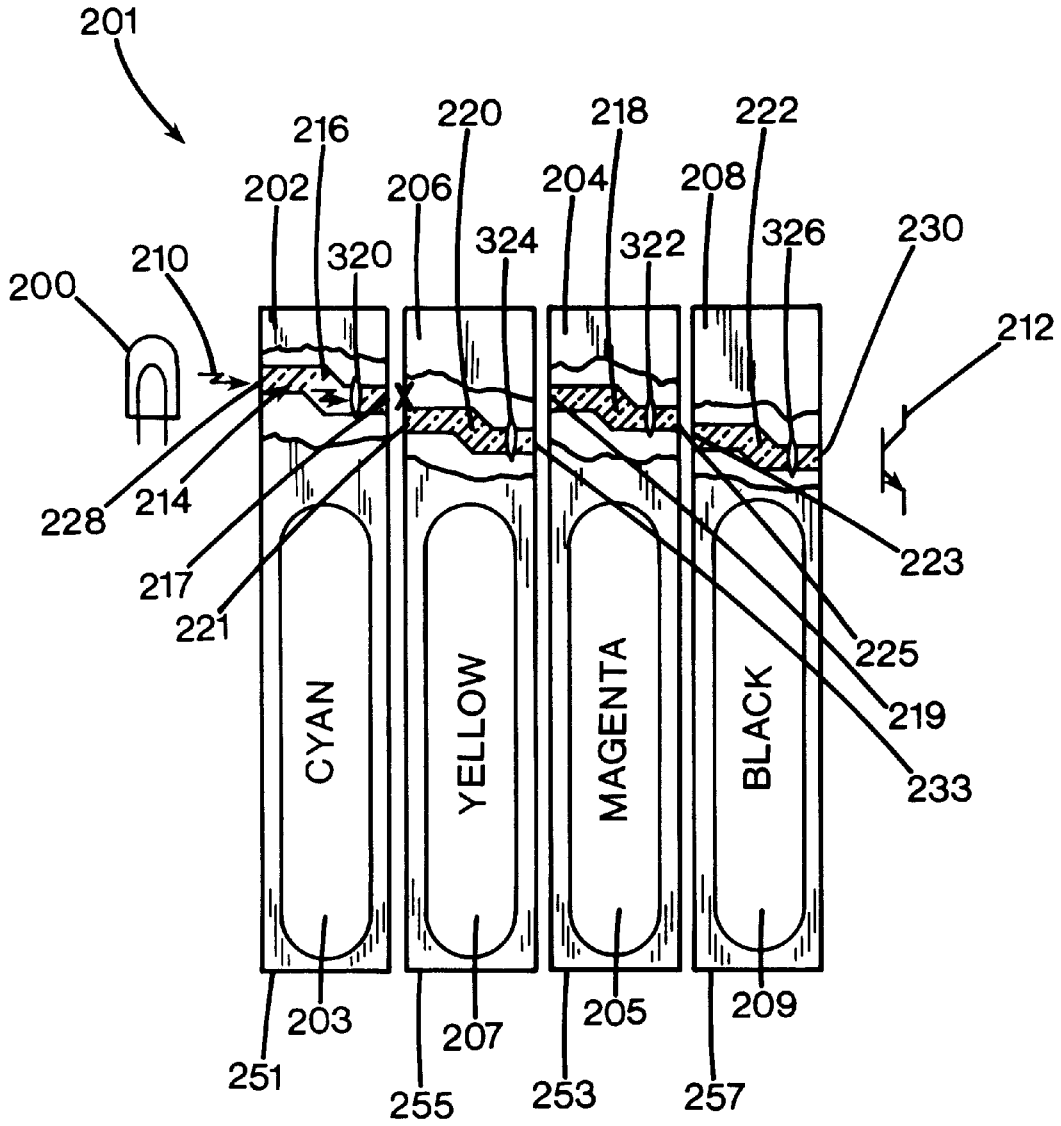
FIG. 7 is a view of the detection apparatus of FIG. 4 indicating that the two middle printing composition containers have been swapped.

FIG. 7 shows containers 202, 204, 206, and 208 with offset light pipe elements because the middle two ink containers 204 and 206 have been improperly swapped. The light signal conducting path or circuit between the light source 200 and light detector 212 is broken because light inlet 221 of light pipe element 220 in the incorrectly installed ink container 206 is not aligned with the light outlet 217 of the adjacent light pipe segment 216. This condition is generally indicated by the "X" at light outlet 217 in FIG. 7. Thus, with the present invention, it is possible to detect when any of the containers are installed in an improper receptacle.

Figure 8:
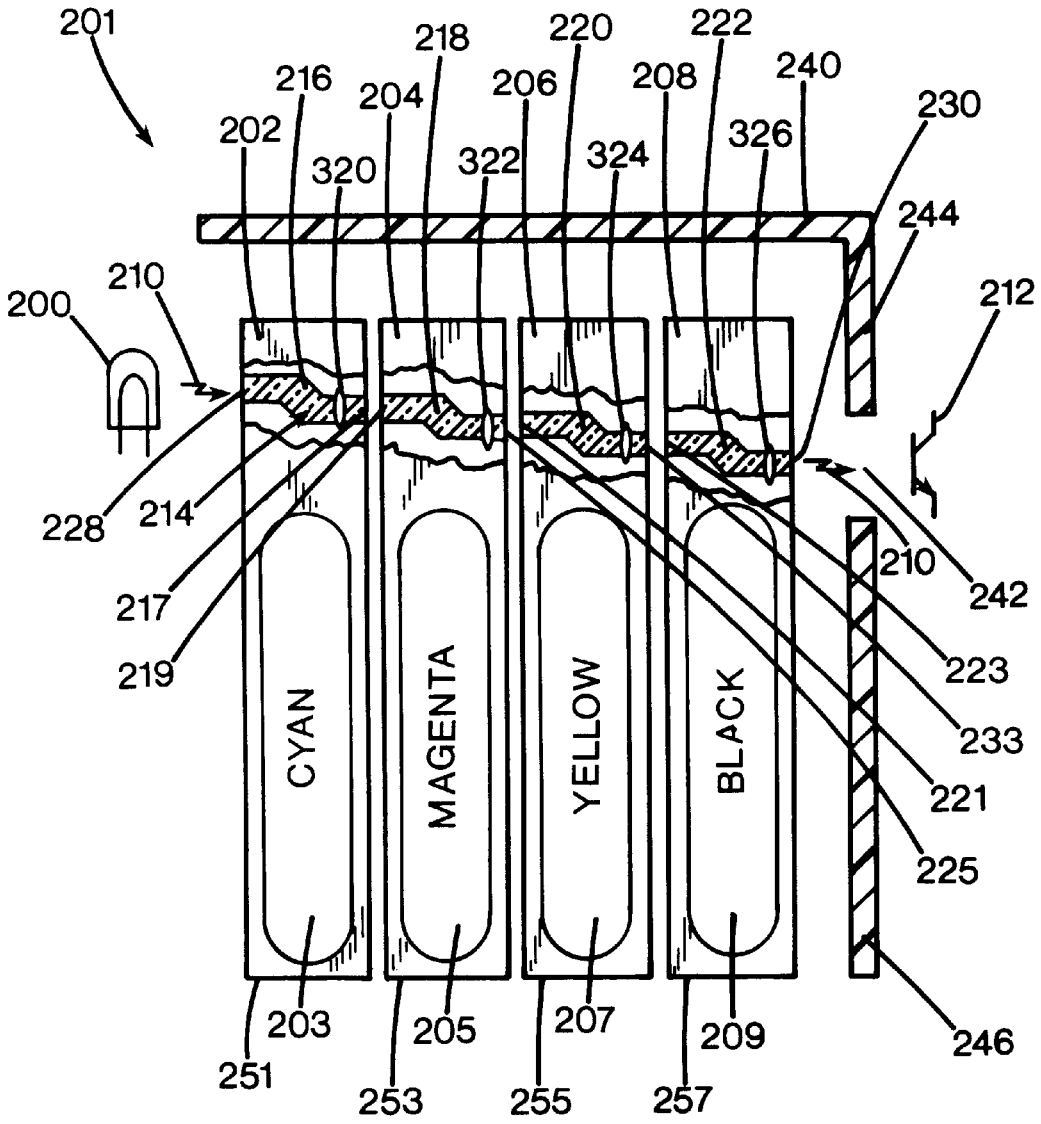
FIG. 8 is a view of the detection apparatus of the present invention used to verify both that the printing composition containers are properly installed in adjacent receptacles of a printing device and that an access door of the printing device is properly positioned.
Figure 9:
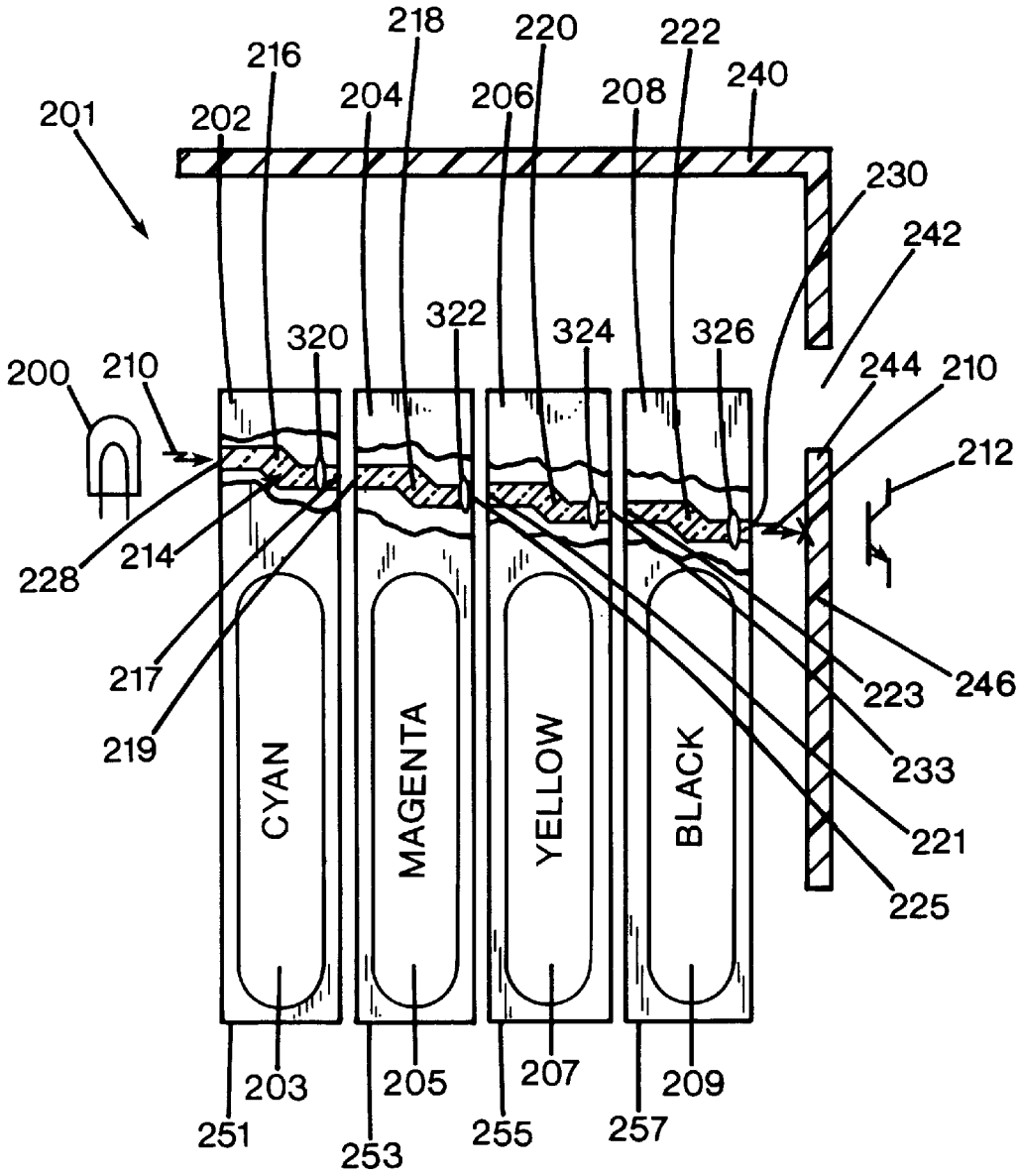
FIG. 9 is a view of the detection apparatus of FIG. 8 indicating that the access door of the printing device is improperly positioned.

In addition to detecting that all required printing composition containers are installed, installed in the proper receptacle, and properly seated in the receptacles, light source 200 and light detector 212 can also be used to detect that another element in the printing device, such as an access door 240 (see FIG. 8) is properly positioned. FIG. 8 shows the case where the light path through containers 202, 204, 206, and 208 also passes through an opening 242, defined by wall portions 244 and 246 of access door 240, which is present when access door 240 is in a closed position during printing. When access door 240 is closed as shown in FIG. 8, the light path or circuit is fully formed, thereby indicating that the printing device is ready for operation (i.e., all printing composition containers are properly installed in their respective printing orientations and access door 240 is closed). When access door 240 is open, as shown in FIG. 9, light signal 210 is blocked by wall portion 246 of access door 240, as generally indicated by the "X" adjacent light outlet 230, thereby indicating that the printing composition container installation process is not complete.

Figure 10:
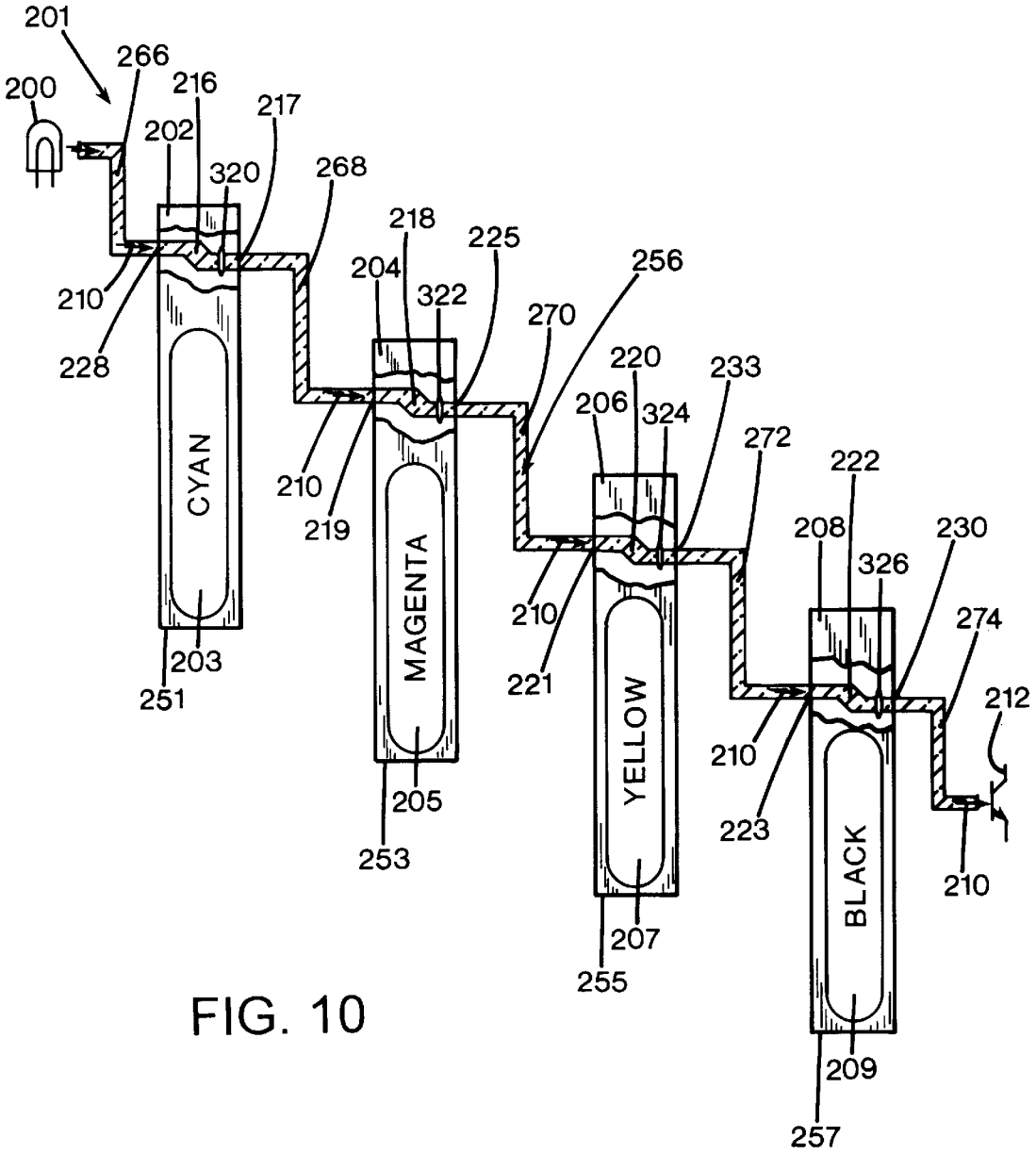
FIG. 10 is a view of an alternative embodiment of the detection apparatus of the present invention in use to verify that four printing composition containers are properly installed in non-adjacent receptacles of a printing device.

It should be noted that the present invention is also designed to work in printing devices where printing composition containers are not mounted in adjacent receptacles. FIG. 10 shows a view of an embodiment of the present invention where containers 202, 204, 206, and 208 are in non-adjacent positions. This embodiment of the present invention includes a light waveguide 256 having light pipe elements 216, 218, 220, and 222 in respective containers 202, 204, 206, and 208. In this case, additional light pipe elements 266, 268, 270, 272, and 274 of light waveguide 256, located outside of containers 202, 204, 206, and 208 and coupled to elements 216, 218, 220, and 222, guide light from one container to the next, as if they were mounted adjacent to each other. As with light waveguide 214, light waveguide 256 and elements 216, 218, 220, 222, 266, 268, 270, 272, and 274 thereof may also include mirrors, prisms, and/or other optic elements that are used in conjunction with these lights pipes or that replace one or more of them.

As can also be seen in FIG. 10, light pipe elements 266, 268, 270, 272, and 274 are each bent or angled differently than light pipe elements 216, 218, 220, and 222. Light pipe elements 216, 218, 220, 222, 266, 268, 270, 272, and 274 may be made from plastic, glass, or other material having suitable light guiding properties, such as index of refraction. Although not shown, it is to be understood that in other embodiments of the present invention, at least one of the light pipes may be straight or curved and, additionally or alternatively, some of the light pipes may be located in different positions within their respective containers.

Figure 11:
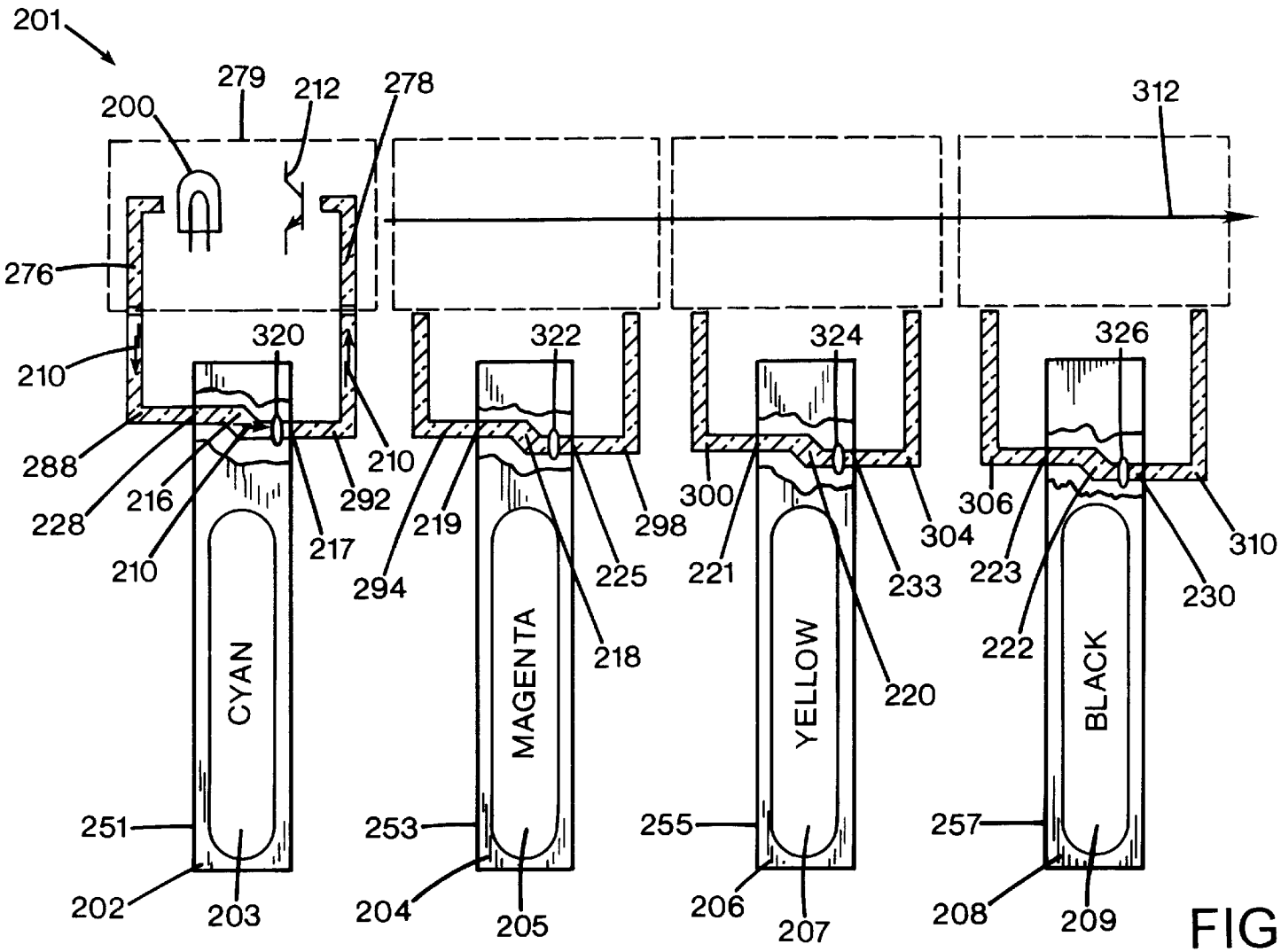
FIG. 11 is a view of an embodiment of a moving detection apparatus of the present invention in use to verify that four printing composition containers are properly installed in receptacles of a printing device.

As shown in FIG. 11, in accordance with the present invention, it is also possible to use a movable member of a printing device, for example carriage 50, to cause translation of components of a light path or light circuit, such as light source 200, light pipe elements 276 and 278 of a light waveguide, and light detector 212. This translation can be used to align the components of a light path or light circuit with different light waveguide elements of printing composition containers such that it is possible to determine not only that a printing composition container is improperly installed, but also which container is improperly installed. FIG. 11 illustrates an example where a translating or movable member 279, shown in outline form only, of a printing device includes both light source 200, light pipe elements 276 and 278, and detector 212. Multiple possible light paths or light circuits are formed between the containers 202, 204, 206 and 208, the container light waveguide elements, in this case light pipe elements 288, 216, 292, 294, 218, 298, 300, 220, 304, 306, 222, and 310, movable light source 200, movable light pipe elements 276 and 278, and movable light detector 212. Examination of the installation characteristics of a particular printing composition container can be made by positioning movable member 279 such that light source 200, light pipe elements 276 and 278, and light detector 212 are aligned with the light pipe elements associated with that particular printing composition container. Such movement of carriage 279, is generally indicated by arrow 312 in FIG. 11. The light waveguides and elements thereof shown in FIG. 11 may vary and have the characteristics of the light waveguides and light waveguide elements discussed above in connection with FIGS. 2–10.

In accordance with the present invention, it is also possible to differentiate between different characteristics or variations of a printing composition in a container by using one or more optical elements, such as filters 320, 322, 324, and 326 in respective light pipe elements 216, 218, 220, and 222, which are colored and/or polarized to filter different frequencies of light, and by using detectors which can detect those frequencies. Along with or instead of such filters, light sources can be used to generate certain frequencies of light or shapes of light signals and light detectors used that detect those frequencies or shapes. For example, it is possible for two different printing devices which required mutually exclusive printing composition formulations (e.g., red ink and green ink) to use the same printing composition containers. One set of containers could be built using a red filter and the other using a green filter. The first printing device would be built with a light detector capable of only responding to red light and the second printing device built with a light detector capable of only responding to green light. In this case, an ink container installed in the wrong printing device could be detected, thus preventing the undesirable mixing of incompatible printing compositions. For example, if a green ink container were installed in a red ink printing device, the red light detector of the red ink printing device would not enable the printing device to draw from the green ink container to being printing because a green light is present rather than a red one.

The above-described filters may be separate elements from the light waveguide or the light waveguide may be made to have a desired characteristic. In the above example, one container could have a red filter and the other container could have a green filter. Alternatively, one of the light waveguides of the containers could be colored red and the other colored green. As a further example, one of the containers could have a red filter and the light waveguide of the other container could be green.

The use of filters can be extended beyond containers to cover the concept of verifying positions of other printing device elements, as discussed above in connection with FIGS. 8 and 9. For example, by placing a light filter element within opening 242 of access door 240 of the device shown in FIGS. 8 and 9 which has a different characteristic than that of any filters used with containers 202, 204, 206, or 208, it would be possible to differentiate between an improper printing composition container installation and door position using the same light path.

Figure 12:
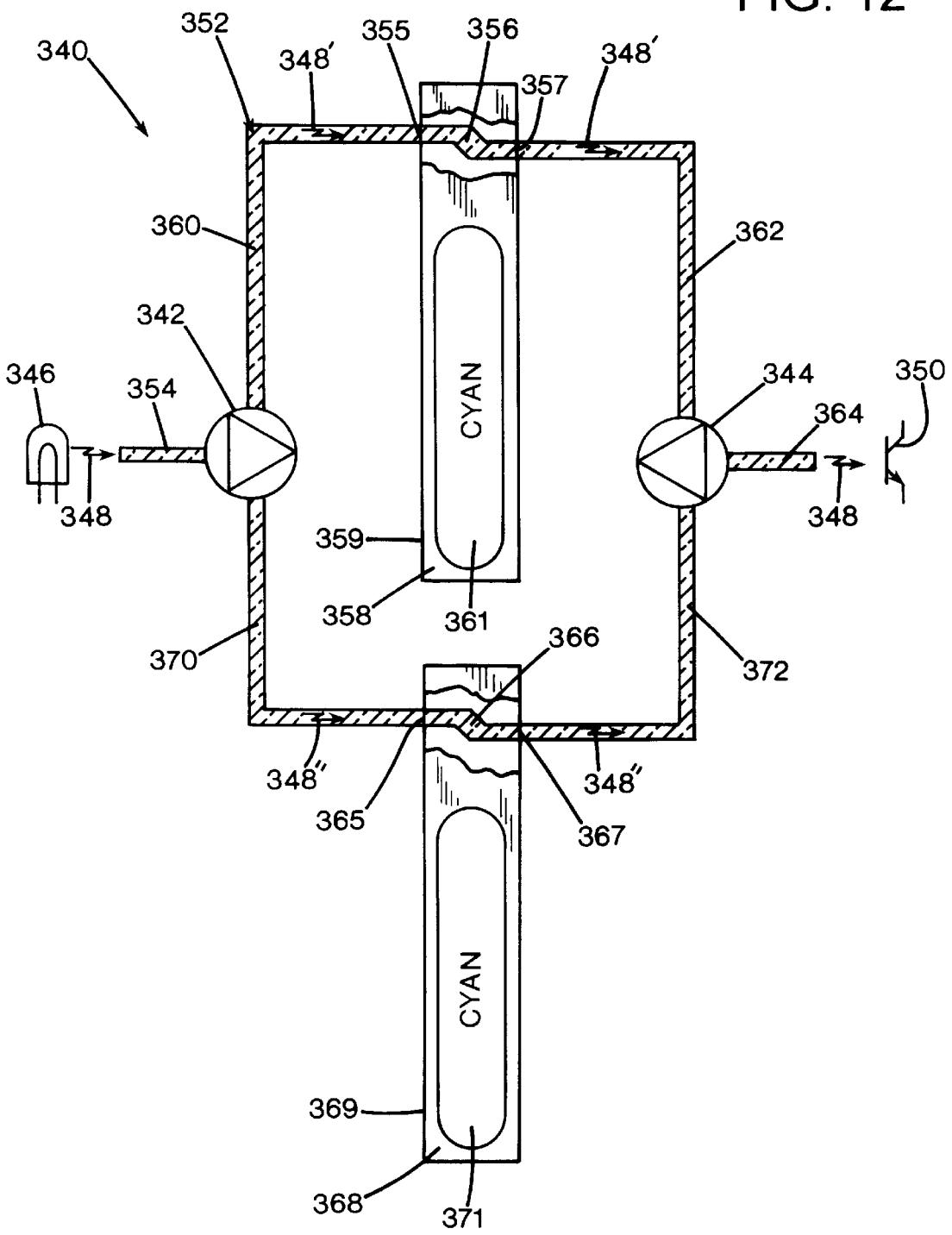
FIG. 12 is a view of detection apparatus constructed in accordance with the present invention that includes a light splitter and a light combiner.

FIG. 12 is a view of detection apparatus 340 in accordance with the present invention that includes a light splitter 342 and light combiner 344, as more fuilly discussed below.

Splitter 342 and combiner 344 may include items such as prisms. Detection apparatus 340 also includes a light source 346 that generates a light signal 348 and a light detector 350. Source 346 and detector 350 may have the characteristics of source 200 and detector 212 discussed above. Detection apparatus 340 also includes light waveguide 352 that includes light pipe element 354 coupled to source 346 and splitter 342, light pipe element 356 in printing composition container 358, light pipe element 360 coupled to splitter 342 and element 356, light pipe element 362 coupled to element 356 and combiner 344, light pipe element 364 coupled to combiner 344 and detector 350, light pipe element 366 in printing composition container 368, light pipe element 370 coupled to splitter 342 and element 366, and light pipe element 372 coupled to element 366 and combiner 344. Containers 358 and 368 include respective housings 359 and 369 in which bodies 361 and 371 are respectively disposed. Bodies 361 and 371 each store a printing composition, such as ink or toner, which is supplied to the printing device. In this case, bodies 361 and 371 are shown as both storing a cyan printing composition. It is to be understood, however, that other colors may be stored in bodies 361 and 371. Bodies 361 and 371 may include such things as bags.

Light inlet 355 and light outlet 357 are formed in housing 359 to which light pipe element 356 is coupled. Light inlet 365 and light outlet 367 are formed in housing 369 to which light pipe element 366 is coupled. As can be seen in FIG. 12, light inlets 355 and 365 are offset from respective light outlets 357 and 367.

As can be seen in FIG. 12, the elements of light waveguide 352 are bent or angled and elements 356 and 366 are located in the same position within containers 358 and 368. However, as with the light waveguides discussed above, it is to be understood that the elements of light waveguide 352 may be differently shaped and/or positioned. Additionally, one or more of the light waveguide elements may be different (e.g., mirrors, prisms, and/or other optic elements).

In operation, splitter 342 sends a portion of light signal 348 in two different directions as illustrated by reference numerals 348' and 348". After passing through light waveguide elements 362 and 372, light signals 348' and 348" are recombined by combiner 344 and sent to detector 350. Use of splitter 342 and combiner 344 allows a single light source 346 and light detector 350 to be used to detect correct installation of two containers. Detection apparatus 340 will allow either container 358 or container 368 to be removed and/or replaced without disrupting operation of the printing device. Operation of the printing device is only disabled if both containers 358 and 368 are removed or improperly installed.

Although not shown, it is to be understood that detection apparatus 340 can be expanded so that single light source 346 and single detector 350 will work with more than two containers. Embodiments for such application may include splitters and combiners that can split a beam into more than two elements and subsequently recombine them. Alternatively, multiple splitters and combiners may be used. Still further modifications or logic combinations are possible. For example, multiple light sources may be used along with a single detector through the use of one or more combiners. Alternatively, a single source may be used along with multiple detectors through the use of one or more splitters. The above-described filters may also be used with detection apparatus 340.

Figure 13:
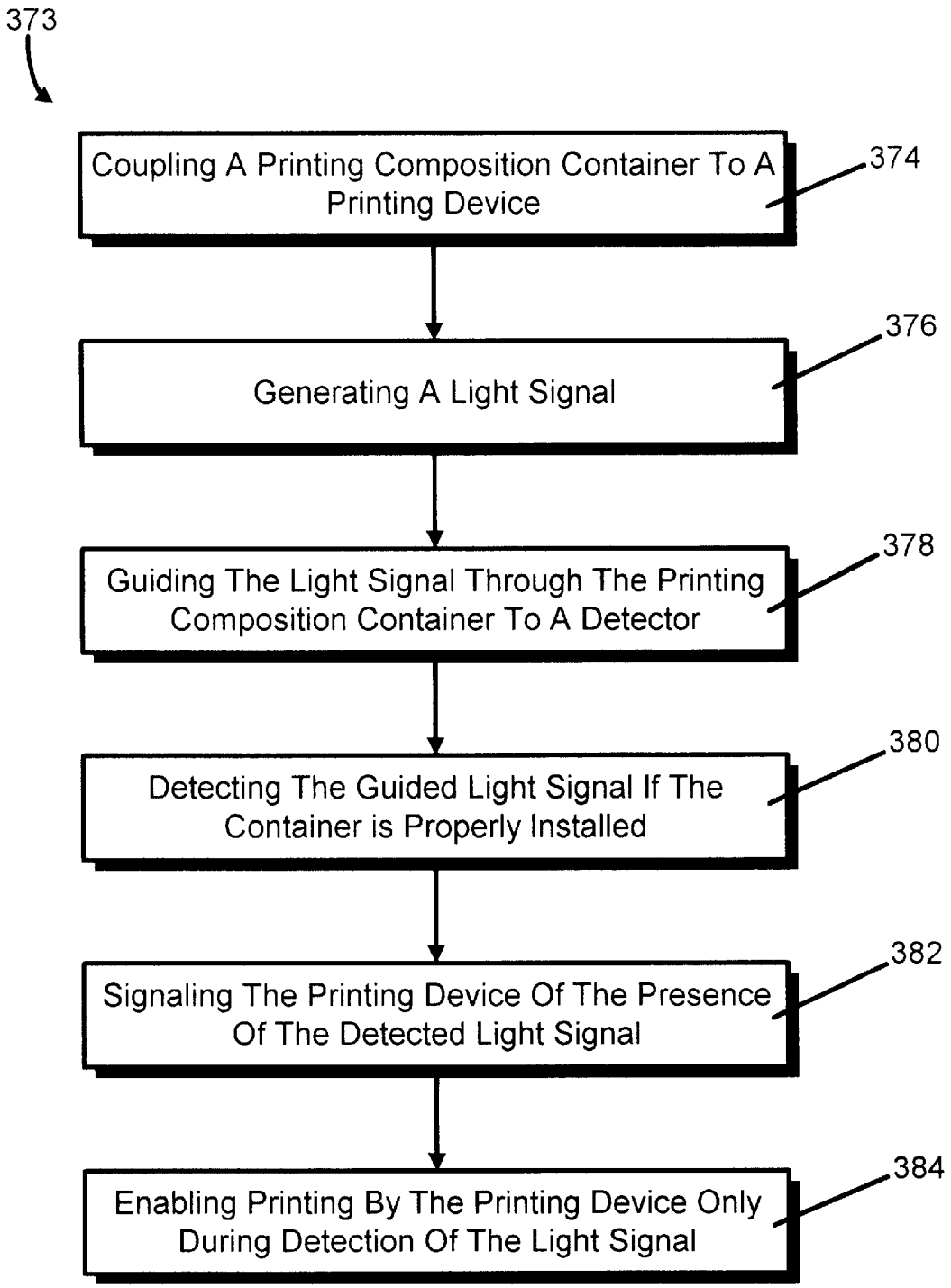
FIG. 13 illustrates a flow diagram of a method of detecting correct installation of a printing composition container in a printing device in accordance with the present invention.

FIG. 13 illustrates a flow diagram of a method 373 of detecting correct installation of a printing composition container in a printing device in accordance with the present invention. The method includes the step of coupling a printing composition container to a printing device 374. Next, a light signal is generated 376 and guided through the printing composition container to a detector 378. If the printing composition container has been coupled to the printing device in its proper printing orientation, then the light signal is detected 380. If the composition container has been improperly coupled to the printing device, then the light signal is not detected. Upon detection, the printing device is signaled of the presence of the detected light signal 382 and the printing device enabled to print during detection of the light signal 384.

Figure 14:
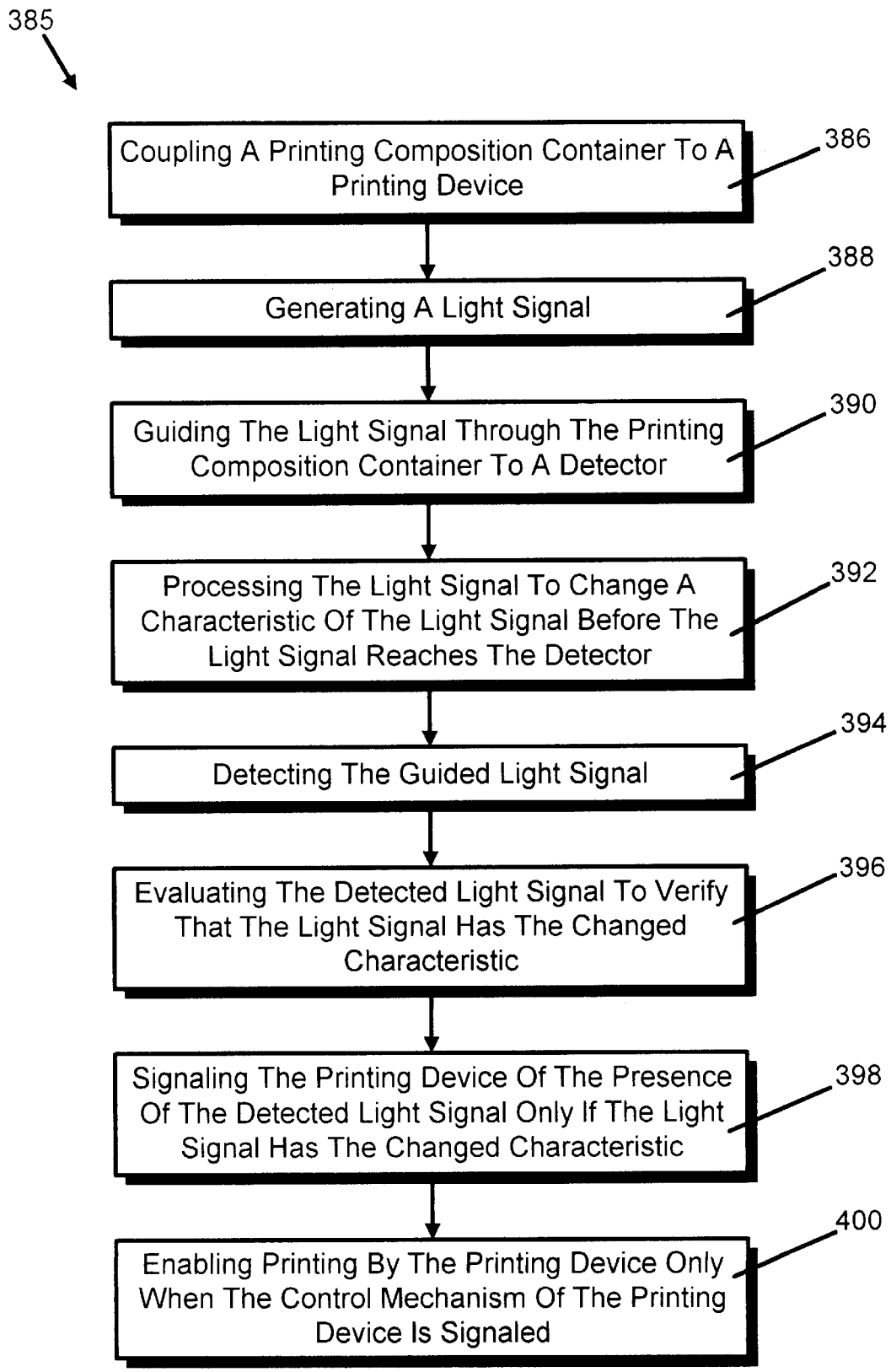
FIG. 14 illustrates a flow diagram of a method of detecting correct installation of a printing composition container that is filled with a printing composition having a particular characteristic in a printing device in accordance with the present invention.

FIG. 14 illustrates a flow diagram of a method 385 of detecting correct installation of a printing composition container that is filled with a printing composition having a particular characteristic in a printing device in accordance with the present invention. The method includes the step of coupling a printing composition container to a printing device 386. Next, a light signal is generated 388 and guided through the printing composition container towards a detector 390. Before reaching the detector, the light signal is processed 392 (e.g., by one or more filters, as discussed above) to change at least one characteristic (e.g., polarization) of the light signal that represents at least one or more characteristics of the printing composition (e.g., fast drying black ink) before the light signal reaches the detector. Next, the light signal is detected 394 and evaluated to verify that the light signal has the changed characteristic 396. If the light signal has the changed characteristic, then the printing composition has the desired characteristic and the printing device is signaled of the presence of the detected light signal 398 which enables printing by the device 400. If the light signal does not have the changed characteristic, then the printing composition lacks the desired characteristic and the printing device is not signaled so that printing does not occur.

Although the invention has been described and illustrated in detail, it is to be clearly understood that the same is intended by way of illustration and example only, and is not to be taken by way of limitation. The spirit and scope of the invention are to be limited only by the terms of the following claims.

What is claimed is:

1. A detection apparatus for use in a printing device, comprising:

a container for storing a printing composition, the container connecting to the printing device in a printing orientation;

a source that generates a light signal;

a detector that detects the light signal from the source when coupled to the source, the detector enabling printing by the printing device when the light signal from the source is detected;

a light waveguide configured to couple the source and detector when the container is connected to the printing device in the printing orientation to enable printing by the printing device, and configured to fail to couple the source and detector when the container is in other than the printing orientation; and further comprising a plurality of containers each of which connects to the printing device in a respective printing orientation, and wherein the light waveguide couples the source and detector only when the containers are connected to the printing device in their respective printing orientations to enable printing by the printing device, and further wherein the light waveguide is configured to fail to couple the source and detector when any of the containers are in other than their respective printing orientations.

2. A detection apparatus for use in a printing device, comprising:

a container for storing a printing composition, the container connecting to the printing device in a printing orientation;

a source that generates a light signal;

a detector that detects the light signal from the source when coupled to the source, the detector enabling printing by the printing device when the light signal from the source is detected;

a light waveguide configured to couple the source and detector when the container is connected to the printing device in the printing orientation to enable printing by the printing device, and configured to fail to couple the source and detector when the container is in other than the printing orientation; and further comprising a plurality of containers each of which couples to the printing device in a printing orientation and a movable member that selectively positions the source and the detector with respect to any one of the containers.

3. The detection apparatus of claim 1 or 2, wherein the light waveguide includes a plurality of separate elements.

4. The detection apparatus of claim 3, wherein a first set of the elements is in each container and a second set of the elements is outside of the containers.

5. The detection apparatus of claim 3, wherein at least two of the elements are different.

6. A detection apparatus for use in a printing device, comprising:

a container for storing a printing composition having a particular characteristic, the container connecting to the printing device;

a source that generates a light signal;

a detector that detects the light signal from the source when coupled to the source, the detector enabling printing by the printing device when the light signal from the source is detected; and a light waveguide;

wherein the light waveguide is configured to couple the source and detector when the container with the particular characteristic is connected to the printing device to enable printing by the printing device;

further wherein the light waveguide is configured to fail to couple the source and detector when the container with the particular characteristic is disconnected from the printing device; and further comprising a plurality of containers each of which stores a printing composition having a different particular characteristic, wherein the light waveguide is configured to couple the source and detector only when all of the containers with the different particular characteristics are connected to the printing device to enable printing by the printing device, and further wherein the light waveguide is configured to fail to couple the source and detector to enable printing by the printing device when any of the containers with the different particular characteristics are disconnected from the printing device.

7. A detection apparatus for use in a printing device, comprising:

a container for storing a printing composition having a particular characteristic, the container connecting to the printing device;

a source that generates a light signal;

a detector that detects the light signal from the source when coupled to the source, the detector enabling printing by the printing device when the light signal from the source is detected; and a light waveguide;

wherein the light waveguide is configured to couple the source and detector when the container with the particular characteristic is connected to the printing device to enable printing by the printing device;

further wherein the light waveguide is configured to fail to couple the source and detector when the container with the particular characteristic is disconnected from the printing device; and further comprising a plurality of containers each of which stores a printing composition having a different particular characteristic and a movable member that selectively positions the source and the detector with respect to one of the containers.

8. The detection apparatus of claim 6 or 7, wherein the light waveguide includes a plurality of separate elements.

9. The detection apparatus of claim 8, wherein a first set of the elements is in each container and a second set of the elements is outside of the containers.

10. The detection apparatus of claim 8, wherein at least two of the elements are different.

11. A detection apparatus for use in a printing device, comprising:

a container for storing a printing composition having a particular characteristic, the container connecting to the printing device;

a source that generates a light signal;

a detector that detects the light signal from the source when coupled to the source, the detector enabling printing by the printing device when the light signal from the source is detected; and a light waveguide;

wherein the light waveguide is configured to couple the source and detector when the container with the particular characteristic is connected to the printing device to enable printing by the printing device;

further wherein the light waveguide is configured to fail to couple the source and detector when the container with the particular characteristic is disconnected from the printing device; and wherein the light waveguide includes a filter that conditions the light signal from the source, and further wherein the detector is configured to detect the conditioned light signal and enable printing only upon detection of the conditioned light signal.

12. The detection apparatus of claim 11, wherein the filter and light waveguide are separate elements.

13. A printing composition container system for use in a printing device, the printing composition container system comprising;

a plurality of housings each of which couples to the printing device in a respective printing orientation;

a light inlet in each of the housings;

a light outlet in each of the housings;

a light waveguide in each of the housings, the light waveguide being coupled to each of the light inlets and each of the light outlets, and the light waveguide being configured to conduct a light signal through all of the light inlets and outlets of the housings when each of the housings is coupled to the printing device in the respective printing orientation for that housing, and the light waveguide being further configured to fail conduct the light signal through all of the light inlets and outlets of the housings when any of the housings is in other than the respective printing orientation for that housing.

14. The printing composition container system of claim 13, wherein the light waveguide includes a plurality of separate elements.

15. The printing composition container system of claim 14, wherein a first set of elements is in each housing and a second set of elements is outside of the housings.

16. The printing composition container system of claim 15, wherein at least two of the elements are different.

17. The printing composition container system of claim 14, wherein at least two of the elements are configured to have a different shape.

18. The printing composition container system of claim 13, wherein at least one light inlet of one of the housings is offset from the light outlet of that housing.

19. The printing composition container system of claim 13, wherein at least one light inlet of one of the housings is offset from at least one light outlet of a different one of the housings.

20. The printing composition container system of claim 13, further comprising a filter that conditions the light signal during conduction through the light waveguide.

21. The printing composition container system of claim 20, wherein the light waveguide and filter are separate elements.

22. The printing composition container system of claim 13, in a printing device.

23. A printing composition container system for use in a printing device, the printing composition container system comprising:

a plurality of housings each of which couples to the printing device in a respective printing orientation;

a light inlet in each of the housings;

a light outlet in each of the housings;

a light waveguide disposed in each of the housings, the light waveguide being coupled to the light inlet and the light outlet in the housing in which the light waveguide is disposed; and a moveable member, the moveable member having a light signal and being configured to be selectively positionable adjacent each of housings to direct the light signal into the light inlet, through the light waveguide, and out of the light outlet of the adjacent housing when the housing is coupled to the printing device in the printing orientation for that housing and to fail to direct the light signal into the light inlet, through the light waveguide, and out of the light outlet of the adjacent housing when the housing is coupled to the printing device in other than the printing orientation for that housing.

24. A method of detecting correct installation of a printing composition container system in a printing device, the method comprising:

coupling a plurality of printing composition containers to the printing device in a printing orientation, each of the printing composition containers including a waveuide;

generating a light signal;

guiding the light signal through the waveguide in each of the printing composition containers to a detector when each printing composition container is coupled to the printing device in the printing orientation for that printing composition container;

detecting the guided light signal; and enabling printing by the printing device only duing detection of the light signal.

25. A method of detecting the presence of a printing composition container system, the method comprising:

coupling a plurality of printing composition containers to the printing device in a printing orientation, each of the printing composition containers including a waveguide;

generating a light signal;

guiding the light signal through the waveguide in each of the printing composition containers towards a detector when each printing composition container is coupled to the printing device in the printing orientation for that printing composition container;

processing the light signal to change a characteristic of the light signal before the light signal reaches the detector;

evaluating the detected light signal to verify that the light signal has the changed characteristic; and enabling printing by the printing device signal only if the light signal has the changed characteristic.

* * * * *